US007827736B2

(12) United States Patent
Sunahara et al.

(10) Patent No.: US 7,827,736 B2
(45) Date of Patent: Nov. 9, 2010

(54) DOOR HANDLE DEVICE FOR VEHICLE

(75) Inventors: Shigeyuki Sunahara, Toyota (JP); Morihito Nomura, Kariya (JP); Koichi Nagata, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 648 days.

(21) Appl. No.: 11/834,029

(22) Filed: Aug. 6, 2007

(65) Prior Publication Data

US 2008/0047203 A1 Feb. 28, 2008

(30) Foreign Application Priority Data

Aug. 25, 2006 (JP) ..... 2006-229155

(51) Int. Cl.
*E06B 3/00* (2006.01)

(52) U.S. Cl. ..... 49/503; 292/336.3

(58) Field of Classification Search ..... 49/503; 292/336.3, 247, 248; 70/207
See application file for complete search history.

(56) References Cited

U.S. PATENT DOCUMENTS 6,363,577 B1 * 4/2002 Spitzley ..... 292/336.3
6,910,303 B1 * 6/2005 Mathofer ..... 49/503
6,964,439 B2 * 11/2005 Nomura et al. ..... 292/336.3
2002/0089194 A1 * 7/2002 Nomura et al. ..... 292/336.3

FOREIGN PATENT DOCUMENTS

JP 2002-004649 A 1/2002

* cited by examiner

*Primary Examiner*—Jerry Redman
(74) *Attorney, Agent, or Firm*—Buchanan Ingersoll & Rooney PC

(57) ABSTRACT

A door handle device for a vehicle includes a frame member mounted to a door of the vehicle, a handle main body fitted with the frame member, an engaging arm formed at the handle main body and engaging with the frame member, a handle axial portion formed at the engaging arm and serving as a pivotal center of the handle main body, a bearing member pivotally supported by the frame member, and a holding portion formed at the bearing member for holding the handle axial portion, wherein the holding portion is shifted between a released position where the handle axial portion is engageable with or disengageable from the holding portion and a supported position where the handle axial portion is pivotally supported with a pivoting of the bearing member.

7 Claims, 7 Drawing Sheets

DOOR HANDLE DEVICE FOR VEHICLE

CROSS REFERENCE TO RELATED APPLICATIONS

This application is based on and claims priority under 35 U.S.C §119 with respect to Japanese Patent Application 2006-229155, filed on Aug. 25, 2006, the entire content of which is incorporated herein by reference.

FIELD OF THE INVENTION

This invention relates to a door handle for a vehicle which opens and closes a door used for a vehicle from outside.

BACKGROUND

A door handle disclosed in JP2002-4649A (P.5, FIGS. 1 and 2) is known as an example of a door handle which opens and closes a door of a vehicle from outside. As illustrated in FIGS. 1 and 2 of JP2002-4649A, the door handle is provided with a frame (frame member) and a grip type handle main body. The frame is fixed to an outer panel from an inner side of the door and the grip type handle main body is tiltably supported by the frame from an outer side of the outer panel. As described above, two separate components are assembled to be used as a door handle. Thus, a rattle occurs in a longitudinal direction of the vehicle between the loosely fitted components due to the assembling structure.

For this reason, as illustrated in FIG. 13, a nut 204 is provided at a front end portion of a frame 202 and a rattle stopper 208 having an engaging jaw 206 is temporarily jointed by way of a screw bolt 210. As illustrated in FIG. 14, a handle axial portion 214 located at a front end portion of a handle main body 212 is engaged with the engaging jaw 206. Then, as illustrated in FIG. 15, a rattle of the handle main body 212 against the frame 202, which occurs in the longitudinal direction of the vehicle at the time of the assembly, is prevented by tightening the screw bolt 210.

This known method is significantly effective for preventing the rattle of the handle main body against the frame, which occurs in the longitudinal direction of the vehicle. However, the method requires three components, i.e. the unit, the rattle stopper, and the screw bolt, to prevent the rattle, thus weight of components, as well as component cost, increases. Further, the assembling work requires a tightening tool and thus hindering workability.

A need exists for a door handle device which is not susceptible to the drawback mentioned above.

SUMMARY OF THE INVENTION

According to an aspect of the present invention, a door handle device for a vehicle includes a frame member adapted to be mounted to a door of the vehicle, a handle main body pivotally fitted with the frame member, an engaging arm formed at the handle main body and pivotally engaging with the frame member, a handle axial portion formed at the engaging arm and serving as a pivotal center of the handle main body, a bearing member pivotally supported by the frame member, and a holding portion formed at the bearing member for holding the handle axial portion, wherein the holding portion is shifted between a released position where the handle axial portion is engageable with or disengageable from the holding portion and a supported position where the handle axial portion is pivotally supported with a pivotal movement of the bearing member.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
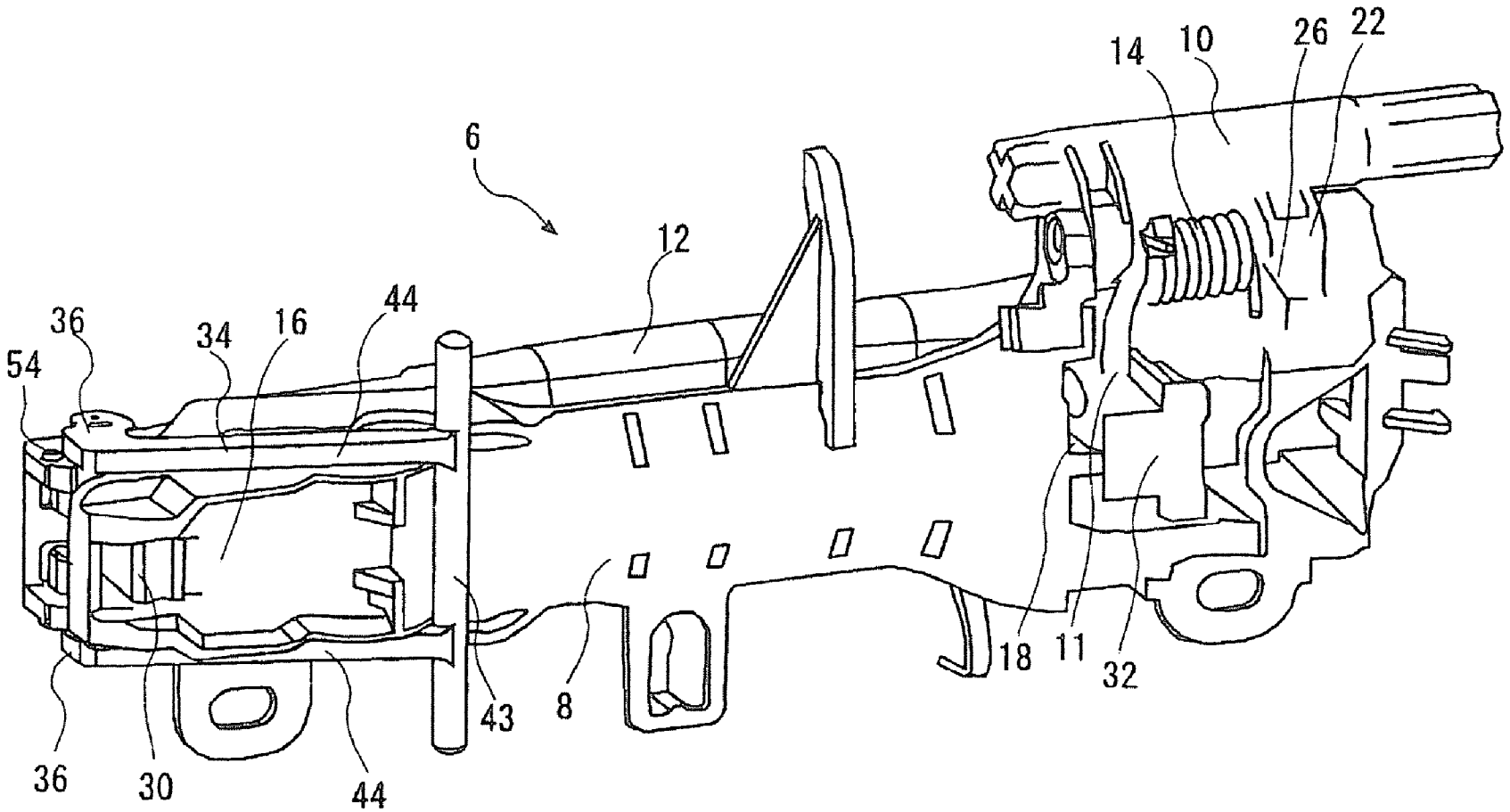
FIG. 1 is a perspective view illustrating an overview of a door handle device for a vehicle according to the present invention.
Figure 2:
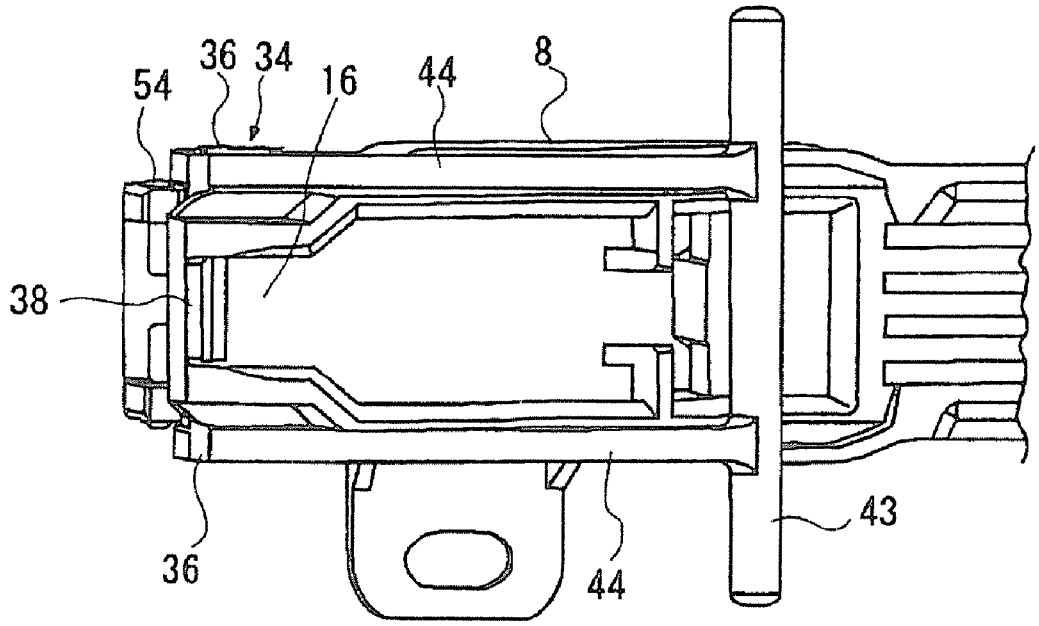
FIG. 2 is a fragmentary view illustrating the door handle device for the vehicle viewed from an inner side of a vehicle cabin.

An embodiment of a door handle device for a vehicle according to the present invention will be described below with reference to drawings. FIG. 1 is a perspective view illustrating an entire structure of an handle main body, a frame member and a bearing member and FIG. 2 is an enlarged view illustrating an assembling state of the frame member and the bearing member when viewed from an inner side of the vehicle cabin.

Figure 4:
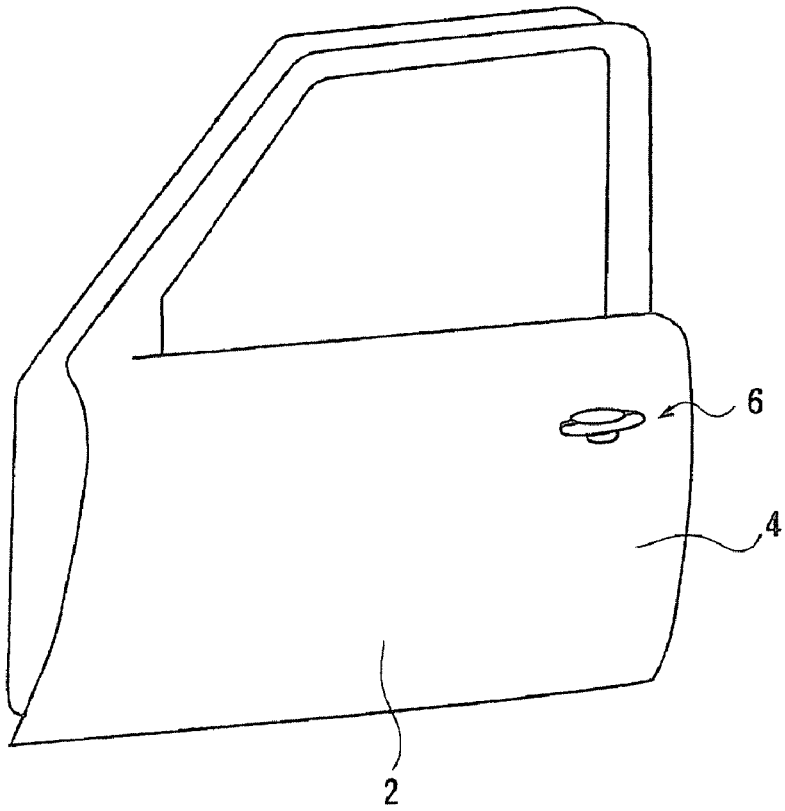
FIG. 4 is a view illustrating a position of the door handle device for the vehicle in a door for the vehicle.

A door handle device for a vehicle 6 is mounted to an outer panel 4 of a door of the vehicle 2. As illustrated in FIGS. 1 and 4, the door handle device for the vehicle 6 is provided with a frame member 8, a lever (counter weight) 10, a grip type handle main body 12 and a coil spring 14. The frame member 8 is fixed to the outer panel 4 from an inner side of the door of the vehicle 2 and the lever 10 is pivotably supported by the frame member 8. The grip type handle main body 12 is tiltably supported by the frame member 8 from an outer side of the outer panel 4 and the coil spring 14 biases the lever 10 for pivotal movement.

Figure 3:
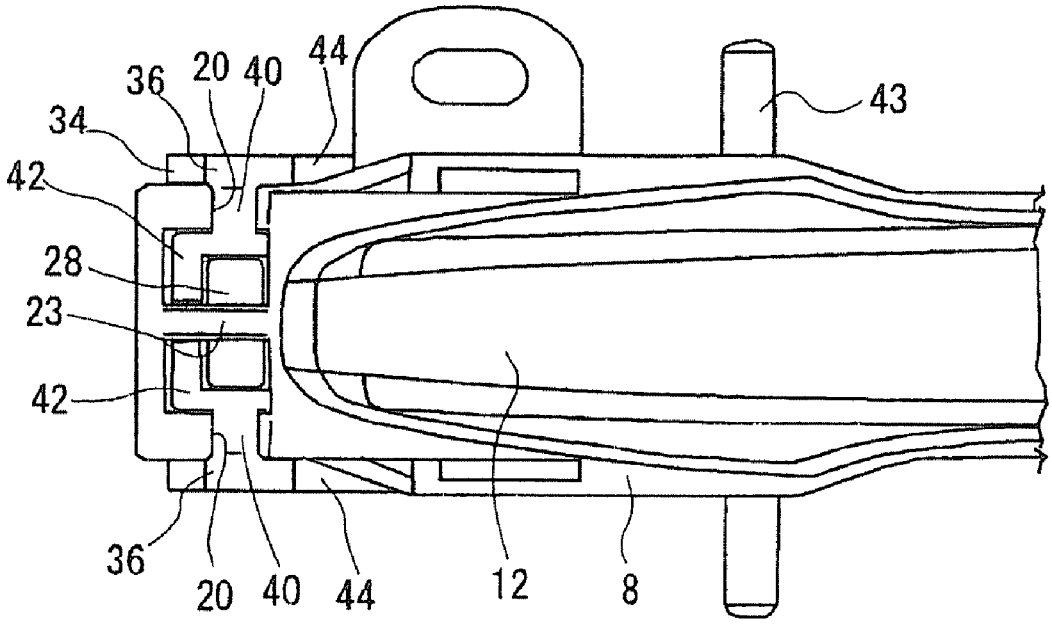
FIG. 3 is a view illustrating the door handle device for the vehicle from an outer side of the vehicle cabin.
Figure 9:
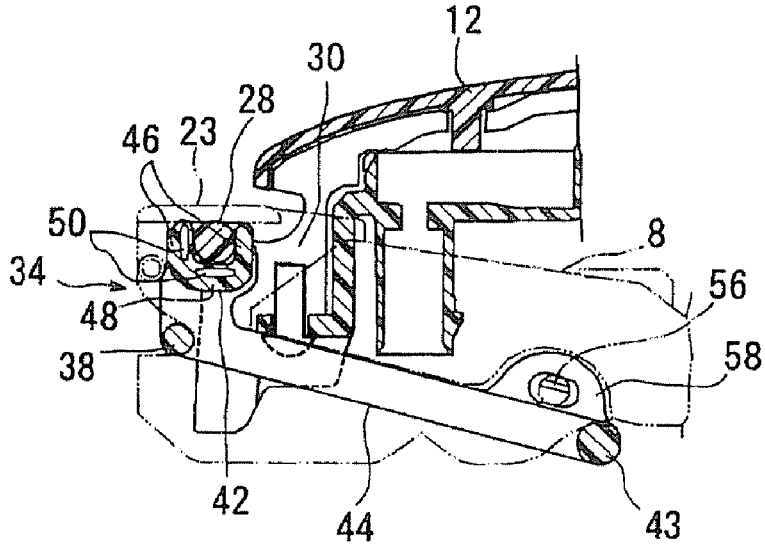
FIG. 9 is a view illustrating an assembling state of the bearing member and the handle axial portion at a supported position.
Figure 11:
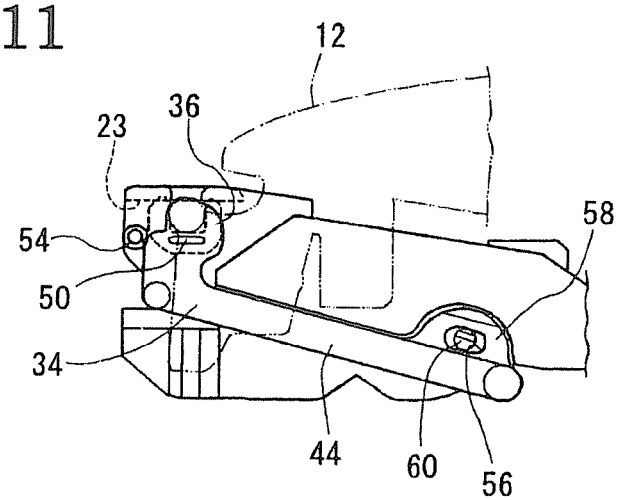
FIG. 11 is a view illustrating the bearing member at the supported position.
Figure 12:
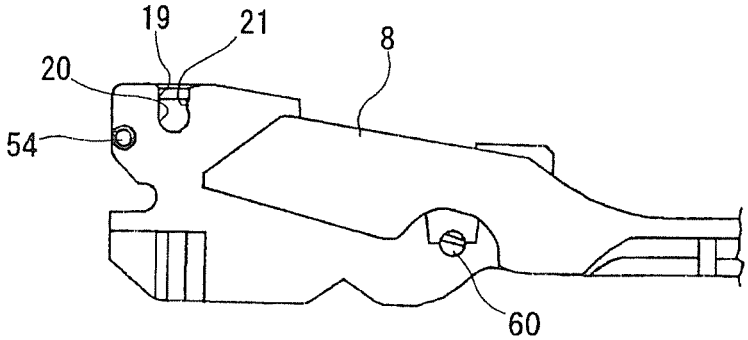
FIG. 12 is a plain view illustrating a bearing hole of a frame member.
Figure 13:
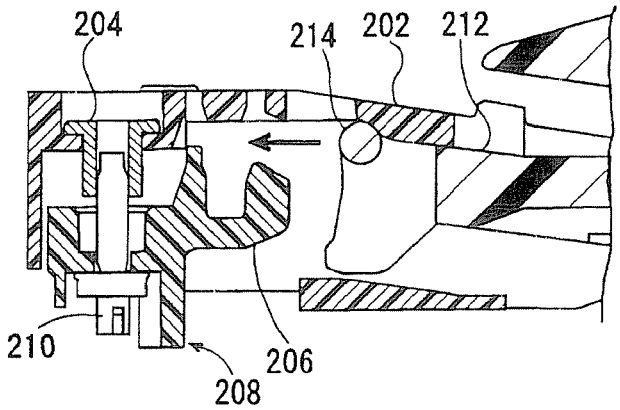
FIG. 13 Prior art
FIG. 13 is a view illustrating a prior art.
Figure 14:
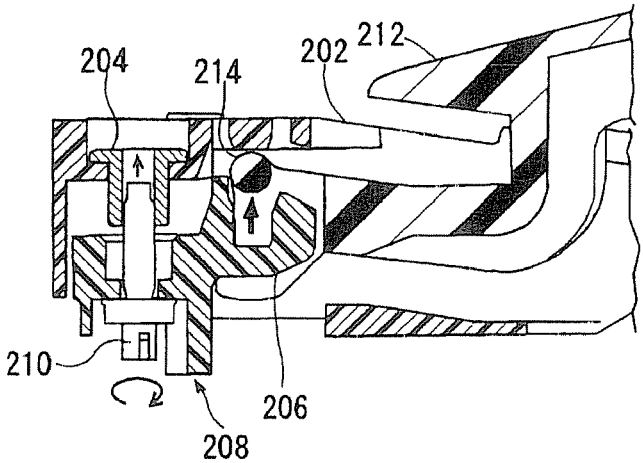
FIG. 14 Prior art
FIG. 14 is a view illustrating the prior art.
Figure 15:
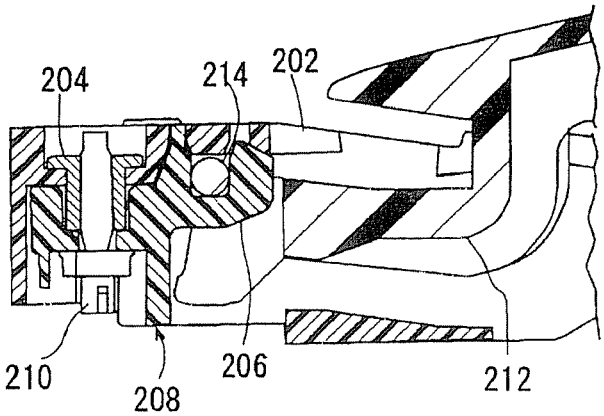
FIG. 15 Prior art
FIG. 15 is a view illustrating the prior art.

As illustrated in FIG. 1, the frame member 8 extends in a longitudinal direction of the vehicle (horizontal direction viewed in FIG. 1) and is formed in an elongated shape. Insertion openings 16 and 18 are respectively formed at front and rear ends of the frame member 8. A bearing hole 20 is formed at both upper and lower sides of the frame member 8, respectively. The bearing holes 20 are located in the vicinity of the insertion opening 16 and serve as bearing means which support a bearing member 34 which will be described below. As illustrated in FIGS. 3 and 12, the bearing holes 20 are provided at end portions of the upper and lower sides of the frame member 8 facing each other. An engagement path 19 is formed in each bearing hole 20 and the engagement paths 19 open to an outer side of the vehicle cabin to allow supporting shafts 40 of the bearing member 34, which will be described below, to engage with or disengage from the bearing holes 20. As illustrated in FIG. 12, a narrowing portion is provided in each engagement path 19 to form a stopper 21. As illustrated in FIGS. 3, 9 and 12, a plate shaped external supporting portion 23 is mounted in the longitudinal direction of the vehicle at the outer side of the vehicle cabin relative to a transverse direction of the vehicle (upper side viewed in FIGS. 9 and 11). The mounting position of the external supporting portion 23 corresponds to an intermediate position between the facing bearing holes 20. Further, a supporting portion 22 and a holding portion 26 are integrally formed with the frame member 8 so as to be located in the vicinity of the insertion opening 18. The supporting portion 22 supports the lever 10 and the holding portion 26 holds the coil spring 14.

Similarly to the frame member 8, the handle main body 12 extends in the longitudinal direction of the vehicle and is formed in an elongated shape. As illustrated in FIG. 1, in a front end of the handle main body 12 (left side viewed in FIG. 1), an engaging arm 30 protrudes toward the inner side of the vehicle cabin to be inserted into the insertion opening 16. A handle axial portion 28 is protruded in a pivotal (vertical) direction of the engaging arm 30 at a distal end of the engaging arm 30, and the handle axial portion 28 is tiltably engaged with the frame member 8 via the bearing member 34 which will be described later. Also, in a rear end of the handle main body 12, an engaging leg 32 is formed so as to protrude toward the inner side of the vehicle cabin. The engaging leg 32 is inserted into the insertion opening 18 and engages with an input portion 11 of the lever 10. Here, the lever 10 is biased by the coil spring 14 in a direction that the engaging leg 32 is drawn into the inner side (inner side of the vehicle cabin) of the outer panel 4. The other end of the lever 10 is connected to a door lock (not shown) via a connecting rod (not shown).

Figure 5:
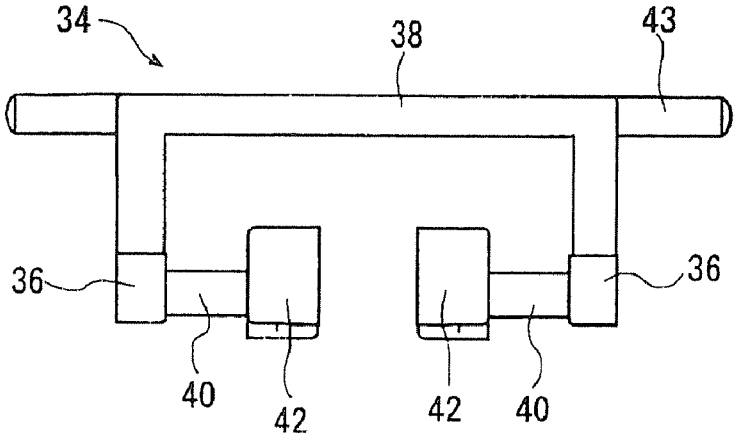
FIG. 5 is a plain view of a bearing member.
Figure 6:
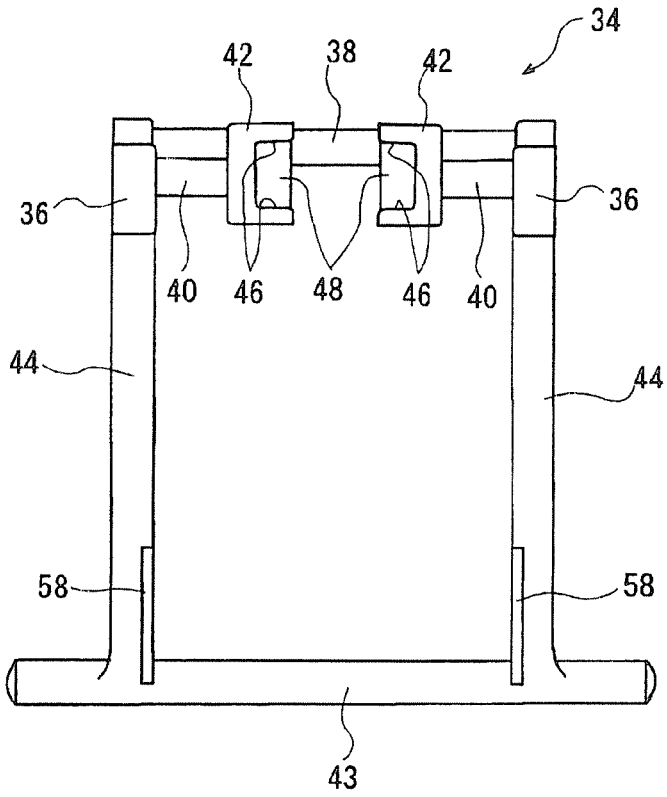
FIG. 6 is an elevation view of the bearing member.

The bearing member 34 journals and assembles the handle axial portion 28 of the handle main body 12 to the frame member 8 so as to be pivotable. As illustrated in FIG. 3, the bearing member 34 includes shaft holding portions 36 and the supporting shafts 40. The shaft holding portions 36 are provided so as to sandwich the frame member 8 therebetween and face each other in the pivotal direction of the bearing member 34. The supporting shaft 40 protrudes from each of the shaft holding portions 36, which face each other, toward its axial inner side to be journaled by the bearing hole 20. As illustrated in FIGS. 5 and 6, the bearing member 34 further includes holding portions 42, a connecting frame 38 and operating arms 44. As illustrated in FIGS. 5 and 6, the holding portion 42 is provided at a distal end of each supporting shaft 40, and each holding portion 42 opens to its inner side relative to an axial direction of the bearing member 34 and also opens to one direction which is perpendicular to the axial line. The connecting frame 38 is provided in parallel to the supporting shafts 40 and connects the facing shaft holding portions 36 to each other. Each operating arm 44 is provided continuously from the corresponding shaft holding portion 36 and protrudes perpendicular to the supporting shaft 40. The operating arms 44 are connected to each other at facing distal ends thereof by a holding rod 43, which extends in the pivotal direction of the bearing member. These components are integrally formed with the bearing member 34 by a material such as a hard synthetic resin.

Figure 7:
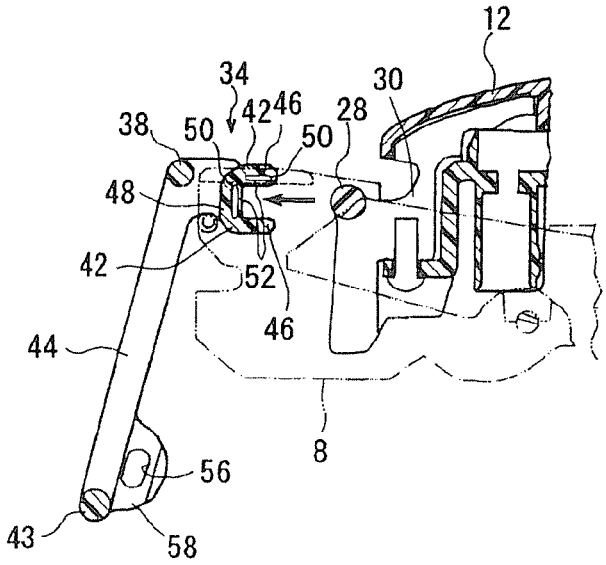
FIG. 7 is a view illustrating a state in which a handle axial portion is assembled to the bearing member.

As illustrated in FIG. 6, a cross section of the holding portion 42 is formed in an approximate U shape and each holding portion 42 includes a pair of supporting side portions 46 and a supporting bottom portion 48. The engaging arm 30 of the handle main body 12 is inserted between the facing holding portions 42, and the handle axial portion 28, which protrudes from the engaging arm 30, is inserted into each opening of the holding portions 42 to be journaled. A holding surface of each holding portion 42 is structured of contacting surfaces of the supporting side portions 46 and the supporting bottom portion 48, which contact with the handle axial portion 28. Then, an axial center of the handle axial portion 28 journaled by the holding portions 42 and axial centers of the supporting shafts 40 are arranged concentrically. Also, as illustrated in FIG. 7, clearances 50 are respectively provided at one of the supporting side portions 46 (one located in an upper side in FIG. 7) and the supporting bottom portion 48 along the contacting surfaces contacting with the handle axial portion 28 to form elastically deforming portions 52. When a load is applied from the handle axial portion 28, the clearances 50 are compressed in the elastically deforming portions 52.

Figure 10:
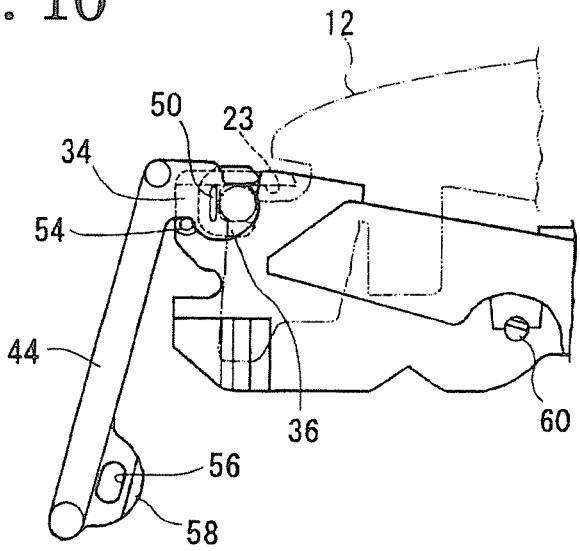
FIG. 10 is a view illustrating the bearing member at the released position.

When the openings of the holding portions 42 open to a rear side relative to the longitudinal direction of the vehicle (right side viewed in FIGS. 7 and 8), the handle axial portion 28 moves from the rear side relative to the holding portions 42 to be engageable with or disengageable from the holding portions 42. Thus, in this case, the position of the holding portions 42 is a released position. A pivotal end restricting portion (not shown), which restricts one pivotal end of the bearing member 34, is provided at the frame member 8. In addition, as illustrated in FIG. 10, a protruding stopper 54 is provided at end portions of both side surfaces of the frame member 8, and each protruding stopper 54 contacts with an edge of a proximal portion of the corresponding operating arm 44. Specifically, the edges are located at the side of a pivoting direction. The contact stops the free pivotal movements of the operating arms 44 and holds the bearing member 34 at the released position.

When the openings of the holding portions 42 are positioned to face the outer side of the vehicle cabin relative to the transverse direction of the vehicle (upper side viewed in FIGS. 9 and 11), the openings of the holding portions 42 are automatically positioned to face the external supporting portion 23 of the frame member 8. Thus, the handle axial portion 28 engaged with the holding portions 42 is supported between the external supporting portion 23 and the supporting bottom portion 48 in the transverse direction of the vehicle (vertical direction viewed in FIGS. 9 and 11). Also, the handle axial portion 28 is supported between the pair of the supporting side portions 46 in the longitudinal direction of the vehicle (horizontal direction viewed in FIGS. 9 and 11). Thus, the handle axial portion 28 is pivotally journaled. The position of the holding portions 42 under the above condition is a supported position. In the supported position, the connecting frame 38 contacts with the front end of the frame member 8 and the holding rod 43 contacts with an end surface of the frame member 8 located at the inner side of the vehicle cabin. These contacts restrict the other pivotal end of the bearing member 34, thereby forming another pivotal end restricting portion. Also, an engaging portion 58, in which an engaging hole 56 is formed, is provided at a side surface of a distal end of each operating arm 44. The engaging holes 56 engage with a pair of engaging protrusions 60 provided at upper and lower side surfaces of the frame member 8. The engagement restricts the free pivotal movement of the operating arm 44 to hold the bearing member 34 at the supported position. The holding rod 43 of the operating arms 44 is formed protruding parallel with the pivotal (vertical) direction of the bearing member 34 to form holding protrusions.

The operation of the door handle device for the vehicle 6, which is configured as described above, will be described below. Firstly, the bearing member 34 is assembled to the frame member 8. The engaging path 19 is provided at each bearing hole 20 of the frame member 8, and thus it is possible to engage each supporting shaft 40 with the corresponding bearing hole 20 easily by inserting the supporting shaft 40 of the bearing member 34 into the bearing hole 20 along the engagement path 19. Further, the stopper 21 is provided at the engagement path 19 and the stopper 21 prevents the supporting shaft 40 from falling off the bearing hole 20 once the supporting shaft 40 is engaged with the bearing hole 20.

Figure 8:
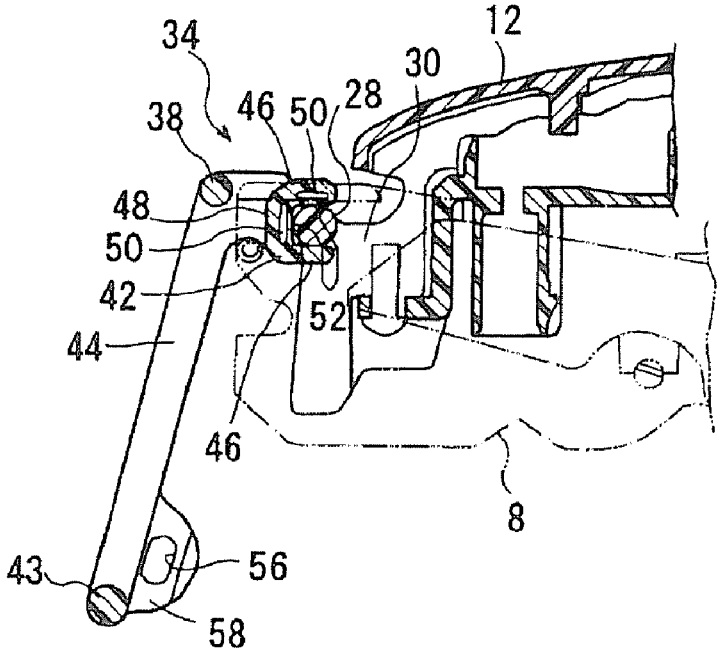
FIG. 8 is a view illustrating an assembling state of the bearing member and the handle axial portion at a released position.

When the handle main body 12 is assembled to the frame member 8, the engaging arm 30 and the engaging leg 32 are inserted from the insertion openings 16 and 18 of the frame member 8, respectively. At the time, as illustrated in FIG. 7, the bearing member 34 is pivoted to the released position by operating the operating arms 44 and is held at the released position by way of the protruding stopper 54 and the like. Then, as illustrated in FIG. 8, the handle axial portion 28 of the engaging arm 30 is inserted into the holding portions 42 of the bearing member 34 to be journaled. At the time, the bearing member 34 is positioned so that the openings of the holding portions 42 face to the rear side of the vehicle (right side viewed in FIGS. 7 and 8), and therefore the handle axial portion 28 is moved from the rear side of the vehicle to engage with the bearing member 34 easily. At the time, the engage leg 32 is engaged with the input portion 11 of the lever 10 to bias the lever 10 in a direction that the engaging leg 32 is drawn into the inner side (inner side of the vehicle cabin) of the outer panel 4.

Next, the bearing member 34 is pivoted to the supported position by operating the operating arms 44. When the bearing member 34 is pivoted, the operating arms 44 pass over the protruding stoppers 54 to pivot. In the supported position, as illustrated in FIGS. 9 and 11, the openings of the holding portions 42 of the bearing member 34 are positioned to face the outer side of the vehicle cabin relative to the transverse direction of the vehicle (upper side viewed in FIG. 9). Thus, the openings of the holding portions 42 face the external supporting portion 23 of the frame member 8. Therefore, the handle axial portion 28 is supported at its both sides by the external supporting portion 23 and the supporting bottom portion 48 in the transverse direction of the vehicle (vertical direction viewed in FIG. 9), and is also supported by the pair of the supporting side portions 46 in the longitudinal direction of the vehicle (horizontal direction viewed in FIG. 9). The movement of the handle axial portion 28 against the frame member 8 is restricted in the transverse and longitudinal directions of the vehicle. As described above, in the supported position, the handle main body 12 pivots with the handle axial portion 28 serving as a pivotal center without causing the rattle against the frame member 8 in the transverse and longitudinal directions of the vehicle.

As described above, it is possible to engage the handle axial portion 28 with the frame member 8 easily by using the single component, i.e. the bearing member 34. Further, it is possible to pivotally support the handle axial portion 28 restricting the movements (rattle) of the handle axial portion 28 against the frame member 8. Therefore, it is possible to reduce the number of the components and the component cost. Also, it is possible to improve the workability of the assembly work.

When the handle axial portion 28 is held by the holding portions 42, the elastically deforming portions 52, which are provided at the supporting side portion 46 and the supporting bottom portion 48, are pressed by the handle axial portion 28 to be bent. The deflection absorbs manufacturing variations between the outer circumference size of the handle axial portion 28 and the size of the space defined between the pair of the supporting side portions 46 and also absorbs manufacturing variations between the outer circumference size of the handle axial portion 28 and the size of the space defined between the external supporting portion 23 and the supporting bottom portion 48. Thus, it is possible to journal the handle axial portion 28 smoothly without having any space between the handle axial portion 28 and the bearing member 34.

When the handle main body 12 is detached from the frame member 8 for maintenance purpose and the like, the operator holds the holding rod 43, which protrudes parallel with the pivotal direction of the bearing member 34, to operate the operating arms 44. Thus, it is possible to easily pivot the bearing member 34 from the supported position to the released position by operating the operating arms 44.

In the embodiment, the bearing holes 20 are provided at the frame member 8 and the supporting shafts 40, each journaled by the corresponding bearing holes 20, are provided at the bearing member 34. However, the configuration is not limited to this form, for example, supporting shafts may be provided at the frame member and the bearing holes may be provided at the bearing member. Also, the engaging arm 30 of the handle main body 12 (handle axial portion 28) is disposed at the front side relative to the longitudinal direction of the vehicle, however, the configuration is not limited to this form. The engaging arm may be disposed at the rear side relative to the longitudinal direction of the vehicle depending on the structure of the door of the vehicle.

The holding rod 43 protrudes parallel with the pivotal direction of the bearing member 34. However, the form of the holding rod is not limited to this. The holding rod does not have to protrude more than width of the operating arm. Also, the holding rod may protrude in one direction.

According to the aforementioned structure, the handle axial portion 28 is engaged with the holding portions 42 when the bearing member 34 is positioned at the released position. Then, the bearing member 34 is pivoted relative to the frame member 8 to be positioned at the supported position. In the supported position, the handle axial portion 28 is pivotally supported by the holding portions 42.

As described above, it is possible to engage the handle axial portion 28 with the frame member 8 by using a single component, i.e. the bearing member 34. Thus, it is possible to reduce the number of the components and the component cost. Also, it is possible to improve the workability of the assembly work.

According to the aforementioned embodiment of the present invention, operating arms 44 are formed at the bearing member 34, and the operating arms 44 protrude in a perpendicular direction to a center of a pivotal axis. Each operating arm 44 is formed with a holding protrusion protruding in at least one of upward and downward directions of the bearing member and being held for pivoting the operating arm 44.

According to the aforementioned structure, when the bearing member 34 is pivoted by the operation of the operating arms 44, which protrude in a perpendicular direction from a center of the pivotal axis, the operating arms 44 are held by the operator. Thus, the bearing member 34 is pivoted with a very small force. Further, when the handle main body 12 is detached from the frame member 8 for maintenance purpose and the like, the holding protrusions are held by the operator to separate the components. Thus, it is possible to pivot the bearing member 34 from the supported position to the released position easily by operating the operating arm 44.

According to the aforementioned embodiment, a door handle device for a vehicle 6 includes supporting shafts 40 provided at the bearing member 34 and protruding in a pivotal direction of the bearing member 34, and bearing holes 20 provided at the frame member 8 for pivotally journaling the supporting shafts 40. Each bearing hole 20 is provided with an engagement path 19 formed for engaging with or disengaging from the supporting shaft 40 in a perpendicular direction to a center of a pivotal axis and a stopper preventing the supporting shaft 40 from falling off the engagement path 19.

According to the aforementioned structure, the engagement path 19 is provided at each bearing hole 20 of the frame member 8. Thus, each supporting shaft 40 of the bearing member 34 is assembled to or removed from the bearing hole 20 easily. Further, the stopper 21 is provided at each engagement path 19. Thus, it is possible to prevent the supporting shafts 40 from falling off the bearing holes 34.

According to the aforementioned embodiment, the holding portion 42 is formed with a holding surface 46, 48 holding the handle axial portion 28 and an elastically deforming portion 52 is included in the holding surface 46, 48. The elastically deforming portion 52 is pressed and bent when the handle axial portion 28 is held.

According to the aforementioned structure, the elastically deforming portions 52 are pressed and bent by the handle axial portion 28. Thus, it is possible to absorb manufacturing variations between the outer circumference size of the handle axial portion 28 and the inner shape size of the holding surface 46, 48 of the holding portion 42. Therefore, it is possible to journal the handle axial portion 28 smoothly without having any clearance between the handle axial portion 28 and the holding portion 42.

The principles, of the preferred embodiments and mode of operation of the present invention have been described in the foregoing specification. However, the invention, which is intended to be protected, is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A door handle device for a vehicle comprising:

a frame member adapted to be mounted to a door of the vehicle;

a handle main body pivotally fitted with the frame member;

an engaging arm formed at the handle main body and pivotally engaging with the frame member;

a handle axial portion formed at the engaging arm and serving as a pivotal center of the handle main body;

a bearing member pivotally supported by the frame member;

a holding portion formed at the bearing member for holding the handle axial portion, wherein the holding portion is shifted between a released position where the handle axial portion is engageable with or disengageable from the holding portion and a supported position where the handle axial portion is pivotally supported with a pivotal movement of the bearing member;

a supporting shaft provided at the bearing member and protruding in a pivotal direction of the bearing member; and a bearing hole provided at the frame member for pivotally journaling the supporting shaft, the bearing hole being provided with:

an engagement path formed for engaging with or disengaging from the supporting shaft in a perpendicular direction to a center of a pivotal axis, and a stopper preventing the supporting shaft from falling off the engagement path.

2. A door handle device for a vehicle according to claim 1, further comprising:

an operating arm formed at the bearing member, the operating arm protruding in a perpendicular direction to a center of a pivotal axis and pivoting the bearing member.

3. A door handle device for a vehicle according to claim 2, wherein the holding portion is formed with a holding surface holding the handle axial portion, an elastically deforming portion is included in the holding surface, and wherein the elastically deforming portion is pressed and bent when the handle axial portion is held.

4. A door handle device for a vehicle according to claim 1, wherein the holding portion is formed with a holding surface holding the handle axial portion, an elastically deforming portion is included in the holding surface, and wherein the elastically deforming portion is pressed and bent when the handle axial portion is held.

5. A door handle device for a vehicle according to claim 1, wherein an axial center of the handle axial portion and an axial center of the supporting shaft are concentrically arranged.

6. A door handle device for a vehicle comprising:

a frame member adapted to be mounted to a door of the vehicle;

a handle main body pivotally fitted with the frame member;

an engaging arm formed at the handle main body and pivotally engaging with the frame member;

a handle axial portion formed at the engaging arm and serving as a pivotal center of the handle main body;

a bearing member pivotally supported by the frame member;

a holding portion formed at the bearing member for holding the handle axial portion, wherein the holding portion is shifted between a released position where the handle axial portion is engageable with or disengageable from the holding portion and a supported position where the handle axial portion is pivotally supported with a pivotal movement of the bearing member; and an operating arm formed at the bearing member, the operating arm protruding in a perpendicular direction to a center of a pivotal axis and pivoting the bearing member, wherein the operating arm is formed with a holding protrusion protruding in at least one of upward and downward directions parallel with the pivotal direction of the bearing member and being held when pivoting the operating arm.

7. A door handle device for a vehicle comprising:

a frame member adapted to be mounted to a door of the vehicle;

a handle main body pivotally fitted with the frame member;

an engaging arm formed at the handle main body and pivotally engaging with the frame member;

a handle axial portion formed at the engaging arm and serving as a pivotal center of the handle main body;

a bearing member pivotally supported by the frame member;

a holding portion formed at the bearing member for holding the handle axial portion, wherein the holding portion is shifted between a released position where the handle axial portion is engageable with or disengageable from the holding portion and a supported position where the handle axial portion is pivotally supported with a pivotal movement of the bearing member; and an operating arm formed at the bearing member, the operating arm protruding in a perpendicular direction to a center of a pivotal axis and pivoting the bearing member, wherein an engaging hole is provided at a distal end portion of the operating arm, the engaging hole engages with an engaging protrusion provided at the frame member for holding the bearing member at the supported position.

* * * * *